US005259805A

United States Patent [19]

Kieves

[11] Patent Number: 5,259,805

[45] Date of Patent: Nov. 9, 1993

[54] STABILIZED APPENDAGE FOR A NOVELTY BALLOON PRODUCT

[75] Inventor: Garry Kieves, Minneapolis, Minn.

[73] Assignee: Anagram International, Inc., Minneapolis, Minn.

[21] Appl. No.: 882,313

[22] Filed: May 13, 1992

[51] Int. Cl.[5] ..... A63H 27/10

[52] U.S. Cl. ..... 446/220; 446/223

[58] Field of Search ..... 446/220, 221, 223, 225, 446/226, 224, 222; 428/184, 185, 186, 181

[56] References Cited

U.S. PATENT DOCUMENTS

| | | | |
|---|---|---|---|
| 684,561 | 10/1901 | Weston | 428/184 |
| 2,753,658 | 7/1956 | Stickley | 446/223 |
| 3,743,568 | 7/1973 | De Wolf | 428/184 X |
| 4,077,588 | 3/1978 | Hurst | 446/220 X |
| 4,143,195 | 3/1979 | Rasmussen | 428/181 X |
| 4,778,431 | 10/1988 | Dudley | 446/221 |
| 4,917,646 | 4/1990 | Kieves | 446/224 |

OTHER PUBLICATIONS

CTI "Loony" Garfield Leg.
Classic "Beboppers" Hot Stuff Leg.
M&D "Tap Dancers" Pluto Leg.
Anagram "Airwalkers" Cracker Jack Leg.

*Primary Examiner*—Mickey Yu
*Attorney, Agent, or Firm*—Allegretti & Witcoff, Ltd.

[57] ABSTRACT

An appendage for novelty balloon products is disclosed. A pair of heat-sealable strips are secured relative to one another to provide oppositely extending loops, having a predetermined loop configuration upon full extension of the appendage.

5 Claims, 1 Drawing Sheet

STABILIZED APPENDAGE FOR A NOVELTY BALLOON PRODUCT

BACKGROUND OF THE INVENTION

The present invention relates generally to an appendage for a novelty balloon product and more particularly to a stabilized appendage for non-latex, lighter-than-air balloon products.

Non-latex helium-filled balloons (sometimes referred to as metallized balloons) have been popular for many years. See, e.g., U.S. Pat. Nos. 4,077,588 and 4,917,646, the teachings of which are incorporated herein by reference. More recently, appendages have been added to such balloons to provide an animal-like and a human-like configuration. The appendages are typically "honeycomb paper", and the combination of lighter-than-air balloons and appendages gives an appearance of animation under the influence of air currents.

Novelty balloon products of this type are described in U.S. Pat. No. 4,778,4311 (hereinafter "Dudley patent"). The Dudley patent illustrates a single balloon product with appendages in the form of legs and a dual balloon product with appendages in the form of a neck and legs.

SUMMARY OF THE INVENTION

In a principal aspect, the present invention is a stabilized appendage for such novelty balloon products. Two heat-sealable strips are secured relative to one another and provide oppositely extending loops. The appendage is stabilized in the sense that the configuration of the loops does not change under tension, i.e., the loops are floating and have a predetermined loop configuration at full extension of the appendage.

It is thus an object of the present invention to provide a new stabilized appendage for novelty products. Another object is a honeycomb-like appendage wherein the oppositely extending loops are floating and have a substantially uniform configuration. Yet another object is a durable, lightweight, inexpensive and decorative appendage.

These and other features, objects and advantages of the present invention are set forth or implicit in the following detailed description of certain preferred embodiments.

BRIEF DESCRIPTION OF THE DRAWING

Preferred embodiments of the present invention are described, in detail, with reference to the drawing wherein.

DETAILED DESCRIPTION OF PREFERRED EMBODIMENT

Figure 1:
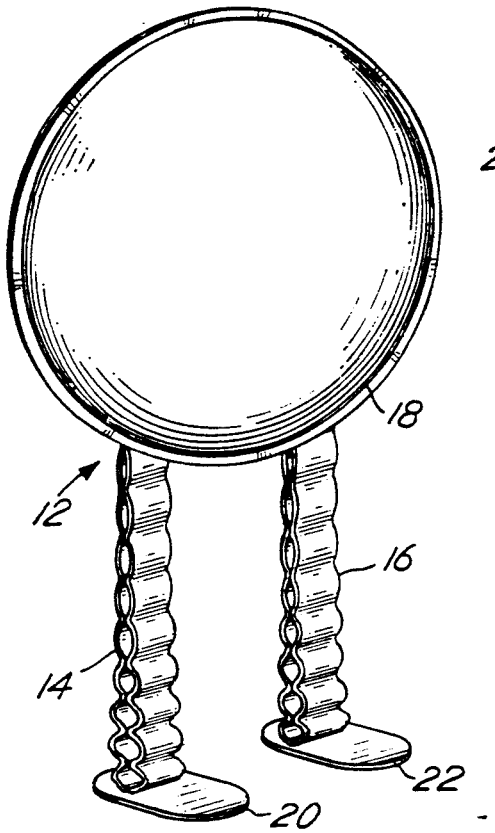
Fig. 1 (PRIOR ART)
FIG. 1 is a perspective view of a prior art novelty balloon product including a pair of honeycomb paper appendages.

Various preferred embodiments of the present invention are shown in FIGS. 2–5 as a stabilized appendage 10 for a novelty balloon product 12, as depicted in FIG. 1. As used herein, the term "novelty balloon product" and obvious derivatives thereof mean any type of novelty product (including without limitation toy, amusement or advertising) having at least one lighter-than-air balloon of any type (including without limitation latex and non-latex).

With regard now to FIG. 1, designated "Prior Art" based in part: upon the Dudley patent, the novelty balloon product 12 includes two honeycomb paper appendages 14, 16, in the form of legs, secured to and extending downwardly from a metallized helium-filled balloon 18, in the form of a body. Two cardboard weights 20, 22, in the form of feet, are secured to the appendages 14, 16, respectively, opposite the balloon 18. The appendages 14, 16 and weights 20, 22 counterbalance the lift of the balloon 18.

Honeycomb paper appendages suffer from several disadvantages. First, the appendage is easily torn which may result in the loss of necessary counterbalance weight. Second, with full extension of the appendage, the honeycomb configuration is lost. Third, the honeycomb paper is relatively heavy and thereby limits the possible combinations and configurations of balloons and appendages. Fourth as typically used, the honeycomb pattern is irregular and unpleasing to the eye. The weight of the appendage actually "stretches" the honeycomb pattern in the upper portion, near the balloon 20, while the lower portion is "compressed", as shown in FIG. 1.

The stabilized appendage 10 substantially avoids these disadvantages, providing a lightweight, yet durable uniform appendage. With reference again to FIGS. 2–4, the stabilized appendage 10 includes first and second heat-sealable strips 24, 26, relatively secured to provide a honeycomb-like appearance. So secured, the strips 24, 26 define a first and second series of floating loops 28, 30 respectively. The loops 28, 30 extend in substantially opposite directions and have a substantially elliptical loop configuration whenever the appendage 10 is fully extended.

The strips 24, 26 are preferably one inch (1") to two inches (2") in width. The strips 24, 26 may be polyethylene, a composite of polyethylene and polyester, or any other heat sealable material. Furthermore the strips 24, 26 may be metallized or decorated.

The appendage 10 is stabilized in that the loops 28, 30 have the predetermined loop configuration with full extension, i.e., the loops 28, 30 are floating whenever the appendage 10 is in its fully extended state. In use, the loops 28, 30 are substantially uniform along the entirety of the stabilized appendage 10.

Figure 2:
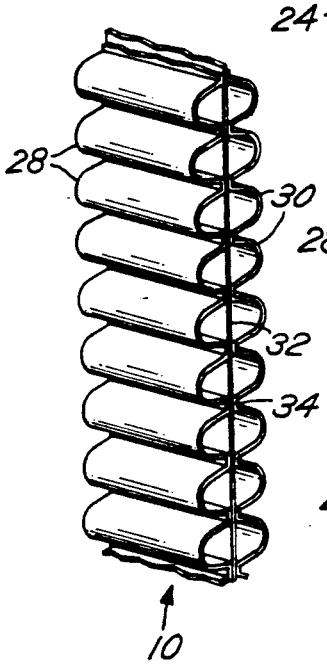
FIG. 2 is a perspective view of a first preferred embodiment of the stabilized appendage.
Figure 3:
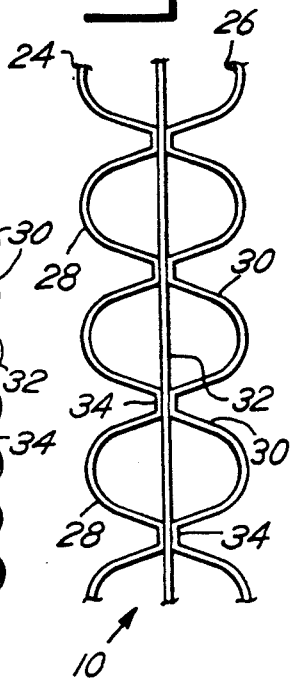
FIG. 3 is an enlarged side view of the stabilized appendage shown in FIG. 2.

With reference to FIGS. 2 and 3, this preferred embodiment of the appendage 10 further includes a central stabilizing strip 32, which defines the fully extended length of the appendage 10. The loops 28, 30 substantially align along the stabilizing strip 32, extending outwardly therefrom. The strips 24, 26 are secured in a relative manner by heat-sealing or heat-staking to the stabilizing strip 32. As best shown in FIG. 3, each strip 24, 26 is heat-sealed to the stabilizing strip 32, substantially adjacent each of the loops 28, 30, respectively. The heat-sealing pattern defines a series of tacked segments 34, extending across the entire width of the strips 24, 26, 30.

Figure 4:
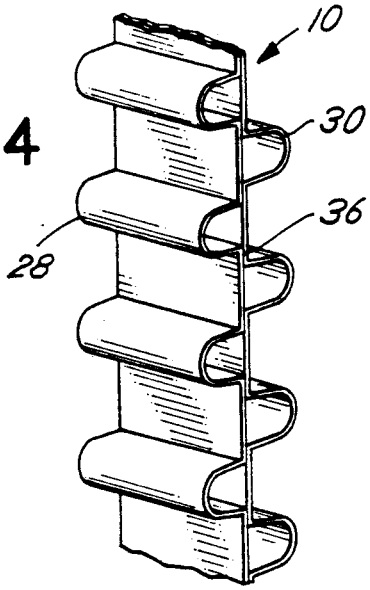
FIG. 4 is a perspective view of a second preferred embodiment of the present invention.
Figure 5:
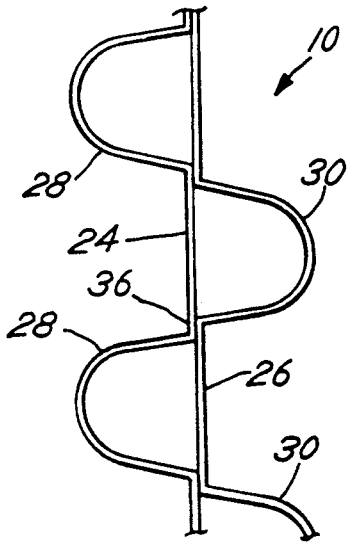
FIG. 5 is an enlarged side view of the stabilized appendage shown in FIG. 4.

A second preferred embodiment is shown in FIGS. 4 and 5. Here the loops 28, 30 are substantially offset, i.e., the loops 28 formed by the strip 24 do not overlap the loops 30 formed by the strip 26 along the appendage 10.

The strips 24, 26 are heat-sealed together substantially adjacent each of the offset loops 28, 30, defining tacked segments 36 and providing the desired floating loop characteristic.

In both embodiments, loop extension, under tension, is restricted. With reference to FIGS. 2 and 3, loop extension is limited by the length of the stabilizing strip 32 between the tacked segments 34; with reference to FIGS. 4 and 5, loop extension is limited to the corresponding strip length between consecutive tacked segments 36.

The stabilized appendage 10 is lightweight and durable compared to honeycomb paper. The appendage 10 may also be heat-staked to the metallized balloon 12 to substantially avoid separation therefrom. The appendage 10 provides a honeycomb-like appearance which is substantially uniform regardless of the exerted tension.

Two preferred embodiments of the present invention have been described. It is to be understood, however, that changes and modifications may be made without departing from the true scope and spirit of this invention as defined by the following claims.

What is claimed is:

1. A novelty balloon product comprising, in combination:

at least a first lighter-than-air balloon; and at least a first stabilized appendage adhered to said first lighter-than-air balloon, said stabilized appendage including first and second heat-sealable strips secured in a relative manner to provide a series of floating loops which extend oppositely and are offset.

2. A novelty balloon product as claimed in claim 1 wherein said first and second heat-sealable strips are heat-sealed substantially adjacent said floating loops.

3. A novelty balloon product comprising, in combination:

at least a first lighter-than-air balloon; and at least a first stabilized appendage adhered to said first lighter-than-air balloon, said stabilized appendage including first and second heat-sealable strips and a stabilizing strip heat-sealed thereto to provide a series of floating loops.

4. A novelty balloon product as claimed in claim 3 wherein said floating loops extend oppositely and are substantially aligned along said stabilizing strip.

5. A novelty balloon product as claimed in claim 4 wherein said first and second heat-sealable strip are heat-staked to said stabilizing strip substantially adjacent said floating loops.

* * * * *